US005874982A

United States Patent [19]

Ueda et al.

[11] Patent Number: 5,874,982

[45] Date of Patent: Feb. 23, 1999

[54] THERMAL PRINTER WHICH DETECTS THE TEMPERATURE OF A THERMAL HEAD TO CENTRAL TEMPERATURE VARIATIONS

[75] Inventors: Satoshi Ueda; Nobuo Katsuma, both of Saitama, Japan

[73] Assignee: Fuji Photo Film Co., Ltd., Kanagawa, Japan

[21] Appl. No.: 543,004

[22] Filed: Oct. 13, 1995

[30] Foreign Application Priority Data

Oct. 17, 1994 [JP] Japan ..... 6-250982

[51] Int. Cl.[6] ..... B41J 2/36; B41J 2/37; B41J 2/365

[52] U.S. Cl. ..... 347/194

[58] Field of Search ..... 347/191, 194, 347/171, 59, 237; 358/502, 503; 400/120.1, 120.14

[56] References Cited

FOREIGN PATENT DOCUMENTS 60-240271 11/1985 Japan .
2-162060 6/1990 Japan .

*Primary Examiner*—Benjamin R. Fuller
*Assistant Examiner*—L. Anderson

[57] ABSTRACT

A thermal printer is provided with a first temperature sensor which is disposed in a substrate of a thermal head, and a second temperature sensor disposed in a housing of the thermal printer. The thermal head has an array of heating elements, each constituted of a resistance layer formed on the substrate, and a grazed glass layer is interposed between the resistance layer and the substrate. An average temperature of the grazed glass layers is calculated from first and second temperatures detected by the first and second temperature sensors, the heat resistance of a path from the substrate to the first temperature sensor, and the heat resistance of an atmosphere in the housing. Based on the calculated temperature, electric energy to be supplied to the thermal head is changed to control heat energy generated from the thermal head.

19 Claims, 5 Drawing Sheets

$$K = \frac{rAL1 + rF + ra}{rF + ra}$$

THERMAL PRINTER WHICH DETECTS THE TEMPERATURE OF A THERMAL HEAD TO CENTRAL TEMPERATURE VARIATIONS

BACKGROUND OF THE INVENTION

1. Field of the Invention

The present invention relates to a thermal printer and a driving method of a thermal head of the thermal printer. More particularly, the present invention relates to a thermal printer which detects the temperature of the thermal head itself and the ambient temperature of the thermal head in order to control temperature variation of the thermal head.

2. Background Art

The thermal printer has a thermal head having a plurality of heating elements which are connected in parallel to one another and arranged in an array. The thermal head gives an amount of heat energy to the thermosensitive recording medium depending on the sensitivity of the recording medium and desirable density of the pixel to record. Specifically, first bias heat energy is applied for heating the thermosensitive recording medium up to such a temperature above which a color begins to be developed. Next, a variable amount of image heat energy necessary for developing the color at desirable density is applied.

On the other hand, the thermal head has an array of heating elements, each constituted of a resistance. Generally, a resistance layer is formed on a substrate, and a pair of electrode layers overlap the opposite ends of the resistance layer. A grazed glass layer is interposed between the resistance layer and the substrate so as to make the outer surface of the heating element convex, and thus ensure the contact with the recording medium or the ink ribbon. On the inner surface of the substrate, i.e., the opposite side from the grazed glass layer, a heat radiation plate is mounted for rapidly cooling the heating element in the cooling periods provided between the heating periods of the heating elements.

The heating elements have a problem that as the print proceed, the thermal head stores heat energy especially in the grazed glass layers, and hence the temperature of the thermal head gradually rises in total. Even though a predetermined electric driving energy is supplied to the resistance to generate a predetermined heat energy, the heat energy applied to the recording medium may change depending upon the temperature of the heating element and the thermal head. Especially the heat accumulation in the grazed glass layer has great influence on the surface temperature of the heating element. As a result, density of an image recorded on a sheet of recording paper tends to be low in the first stage of the printing, and relatively high in the end of the printing. Also when printing a plurality of copies in continuous succession, the first copy tends to have a lower density in total, while the last copy tends to have a higher density in total. This phenomenon is called "shading".

Hereinafter, the variation of temperature of the thermal head due to heat storage or accumulation during printing will be referred to as "a long interval temperature variation of the thermal head".

To solve this problem, JPB 60-240271 discloses a thermal printer wherein drive voltage supplied to the thermal head is controlled based on a temperature measured from the thermal head, such that the head drive voltage is lowered with increasing head temperature, thereby to minimize unexpected variation of the heat energy radiated from the thermal head, i.e. the shading.

Because not only the head temperature but also the temperature of the ink ribbon and/or the recording medium and that of the platen drum or plate have influence on the recording density, it is desirable to take the ambient temperature into consideration. JPB 2-162060 discloses a teaching to provide a second temperature sensor in the ambience of the thermal head, so as to control the energy supply to the thermal head on the basis of the temperature signals from the two sensors.

However, considering the structure of the heating elements as above, it is hard to dispose a temperature sensor, such as a thermistor, adjacent to the outer surface of the heating element or the grazed glass layer. The head temperature sensor is usually disposed in the substrate which is constituted of a ceramic plate and/or an aluminum plate, so that the substrate is interposed between the temperature sensor and the grazed glass layer.

Accordingly, the temperature detected by the conventional head temperature sensor does not directly represent the temperature of the grazed glass layer, but represent the temperature of the substrate which has influence merely indirectly on the surface temperature of the heating element. For this reason, the accuracy of the temperature control of the heating elements and thus the preventing effect against the shading has been insufficient.

OBJECT OF THE INVENTION

In view of the foregoing, a primary object of the present invention is to provide a thermal printer and a thermal head driving method, wherein the drive energy to the thermal head is controlled based on a temperature value which substantially represents a long interval temperature variation of the thermal head due to the heat accumulation, so as to prevent unexpected density variation of the image, especially the shading.

SUMMARY OF THE INVENTION

To achieve the above object, the thermal printer of the invention constitutes a respective heating element of a resistance layer which is formed on a grazed glass layer on a substrate, and disposes a first temperature sensor in a substrate of a thermal head and a second temperature sensor in a housing of the thermal printer the thermal head. The thermal printer of the invention derives a third temperature from first and second temperatures, which are detected by the first and second temperature sensors, as well as the heat resistance of the path from the substrate to the first temperature sensor and the heat resistance of the atmosphere. The third temperature may be considered to be an average temperature of the grazed glass layers of the heating elements of the thermal head. Based on the third temperature, a head driving energy control device controls electric energy to be supplied to the thermal head.

According to the thermal head driving method of the present invention, drive energy supplied to the thermal head is controlled based on a third temperature Tg which is calculated according to the following equation:

$$Tg=\{(rAL+rF+ra)(T_{AL}-Ta)/(rF+ra)\}+Ta$$

wherein rAL: heat resistance of a path from the substrate to the first temperature sensor rF : heat resistance of a radiation plate of a thermal head ra : heat resistance of the atmosphere $T_{AL}$: temperature detected by the first temperature sensor (substrate temperature)

Ta : temperature detected by the second temperature sensor (ambient temperature).

Because the average temperature of the grazed glass layers of the respective heating elements is indicative of the long interval temperature variation of the thermal head, controlling of the drive power, i.e. electric energy, to the thermal head on the basis of the third temperature sufficiently minimizes the long interval temperature variation of the grazed glass layer. Thus, the shading or unexpected density variation is sufficiently prevented.

BRIEF DESCRIPTION OF THE DRAWINGS

Other objects and advantages of the present invention will become apparent in the following detailed description of the preferred embodiments when read in connection with the accompanying drawings, which are given by way of illustration only and thus are not imitative of the present invention, wherein like reference numerals designates like or corresponding parts throughout the several views, and wherein.

DETAILED DESCRIPTION OF THE PREFERRED EMBODIMENTS

Figure 1:
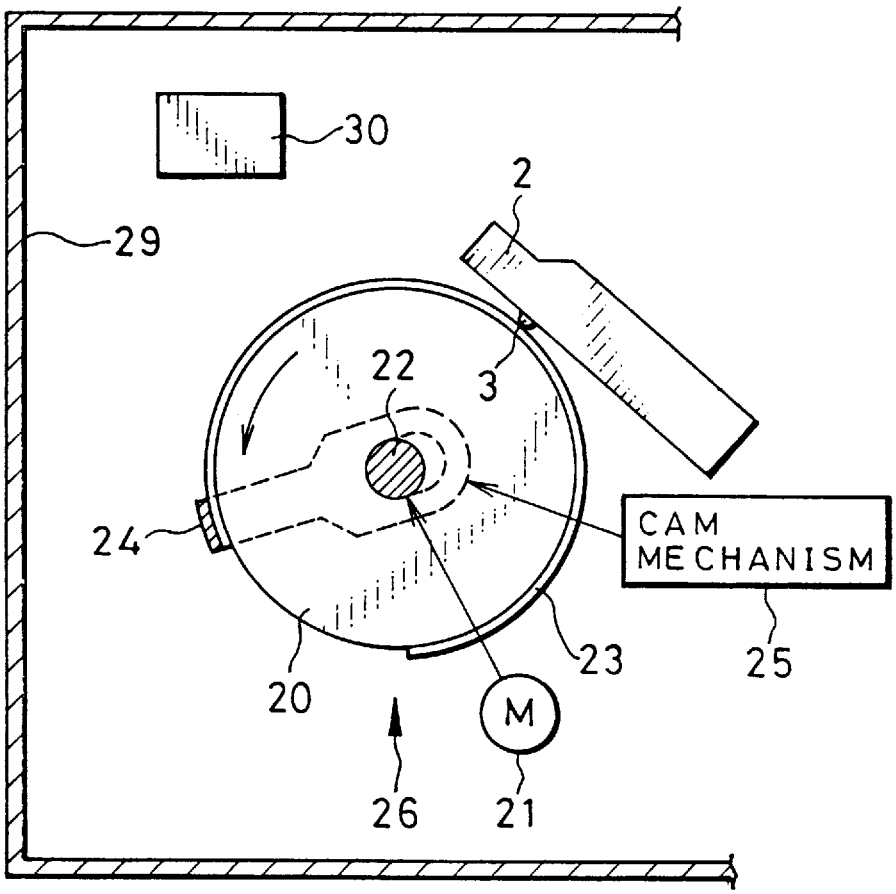
FIG. 1 is a schematic view illustrating a mechanical construction of a direct thermal printer for a monochromatic thermosensitive recording medium.

FIG. 1 shows a thermal printer according to an embodiment of the present invention. A thermal head 2 has an array of heating elements 3. The heating elements 3 radiate equal bias heat energy to each other and then variable heat energy to reproduce gradation of an original half-tone image.

Figure 2:
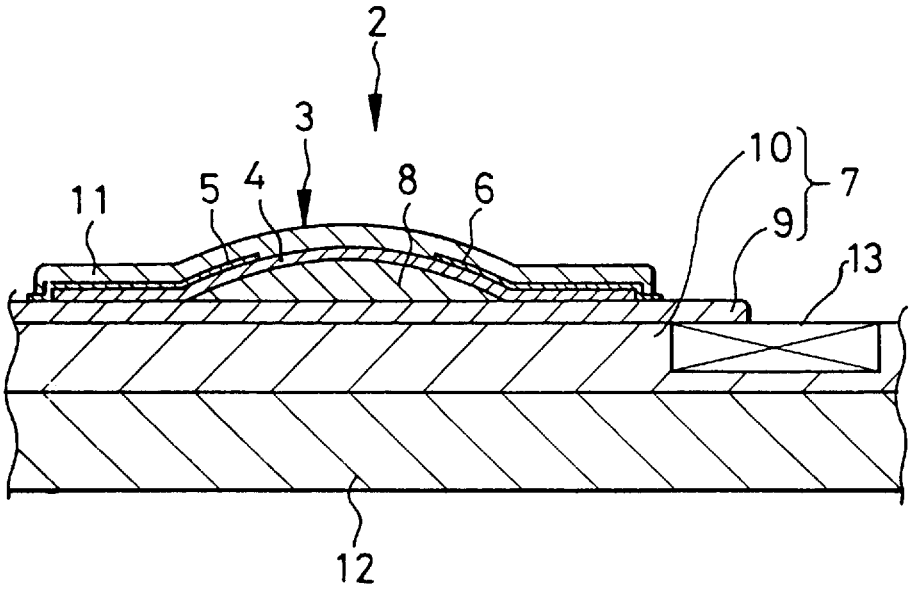
FIG. 2 is a sectional view of an embodiment of heating element of the thermal head of the thermal printer.

FIG. 2 shows a sectional view of an example of the heating element 3. Each heating element 3 is constituted of a resistance layer 4 and a pair of electrodes 5 and 6 connected to the resistance layer 4, which are laminated or formed on a substrate 7 in this order from the inside. A grazed glass layer 8 is formed between the resistance layer 4 and the substrate 7 to make the heating element 3 outwardly convex. The substrate 7 is constituted of a ceramic plate 9 and an aluminum plate 10, and the heating elements 3 are formed on the ceramic plate 9. A protection layer 11 covers and protects the elements 4 to 6 from ambience. A heat radiation plate 12 is mounted on the inside surface of the aluminum plate 10 of the substrate 7. Also, a head temperature sensor, e.g., a thermistor 13 is disposed in the aluminum plate 10, to detect the temperature of the thermal head 2, strictly speaking, the temperature of the substrate 7.

In FIG. 1, a platen drum 20 carries a thermosensitive recording paper 23 on the outer periphery thereof, and is rotated by a pulse motor 21 through a drive shaft 22 in a direction of an arrow, while the thermal head 2 thermally records an image on the recording paper 23. The platen drum 20 is provided with a clamp member 24 which secures the thermosensitive recording paper 23 to the platen drum 20 at least at an end of the recording paper 23. The clamp member 24 is movable between a clamping position and a release position through a cam mechanism 25. The platen drum 20, the pulse motor 21, the clamp member 24, the cam mechanism 25 and not-shown feed rollers constitute a recording medium transport system 26. The thermal head 2 and the recording medium transport system 26 are mounted in a housing 29. Also, an ambient temperature sensor 30 is disposed in the housing 29, to detect the temperature of the interior of the housing 29. In case of a color direct thermal printer, ultraviolet lamps should be disposed around the platen drum 20 in the housing 29, for optical fixation of a magenta recording layer and a yellow recording layer of a color thermosensitive recording medium.

Figure 3:
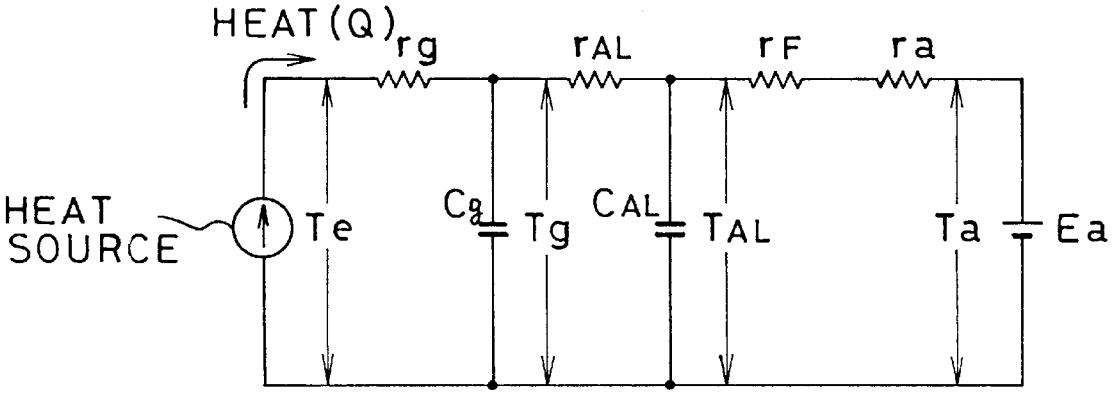
FIG. 3 is a thermal equivalent circuit of the thermal head.

FIG. 3 shows a thermal equivalent circuit of the thermal head 2, wherein Te : surface temperature of the heating element 3 [° C.];

Tg : temperature of the grazed glass layer 8 [° C.];

$T_{AL}$: temperature detected by the head temperature sensor 13 (temperature of the substrate 7) [° C.]

Ta : temperature detected by the ambient temperature sensor 30 (ambient temperature) [° C.]

rg : heat resistance of the grazed glass layer 8 rAL: heat resistance of a path from the substrate 7 to the head temperature sensor 13 [° C./kcal/minute]

rF : heat resistance of a radiation plate of a thermal head [° C./kcal/minute]

ra : heat resistance of an atmosphere [° C./kcal/minute]

Cg : heat capacity of the grazed glass layer 8 [kcal/° C.]

$C_{AL}$: heat capacity of the substrate and the head temperature sensor 13 [kcal/° C.]

Ea : heat source equivalent to the atmosphere in the housing 29 having the temperature Ta [° C.]

Since the grazed glass layer 8 is certainly smaller than the substrate 7, it can be assumed that $rg \cdot Cg < rAL \cdot C_{AL}$. Therefore, the average temperature Tg of the grazed glass layers 8 of the heating elements 3 can be derived from the substrate temperature $T_{AL}$ and the ambient temperature Ta as follows:

$$Tg-Ta=(rAL+rF+ra)\cdot Q \quad (1)$$

$$Tg=(rAL+rF+ra)\cdot Q+Ta \quad (1)'$$

$$T_{AL}-Ta=(rF+ra)\cdot Q \quad (2)$$

$$Q=(T_{AL}-Ta)/(rF+ra) \quad (2)'$$

From the equations (1)' and (2)'

$$Tg=\{(rAL+rF+ra)\cdot(T_{AL}-Ta)/(rF+ra)\}+Ta \quad (3)$$

According to a first embodiment of the present invention, head drive voltage supplied to the resistance layers 4 of the heating elements 3 is modified by a correction value corresponding to the temperature Tg calculated according to the equation (3). Concretely, a predetermined standard voltage for the thermal head is reduced by an amount corresponding to an increase of the temperature Tg. In this way, the long interval temperature variation of the grazed glass layer 7 and thus that of the thermal head 2 are minimized sufficiently enough to prevent the shading. It is to be noted that the equation for calculating the general temperature of the grazed glass layer can be changed according to the structure of the heating elements.

Figure 4:
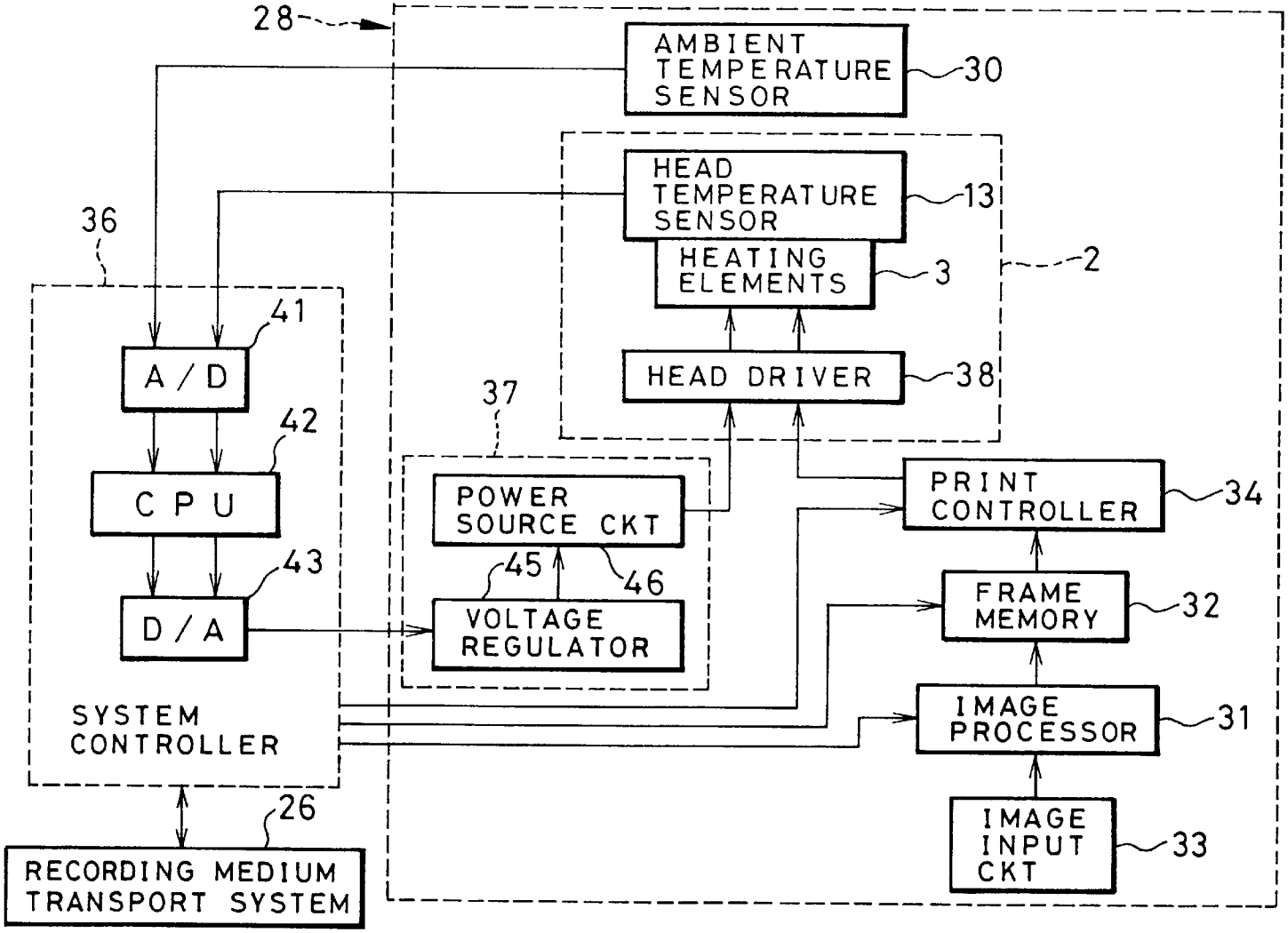
FIG. 4 is a block diagram illustrating an electrical construction of the thermal printer according to a first embodiment of the invention, wherein the head drive voltage is changed to obviate the long interval variation of the head temperature.
Figure 6:
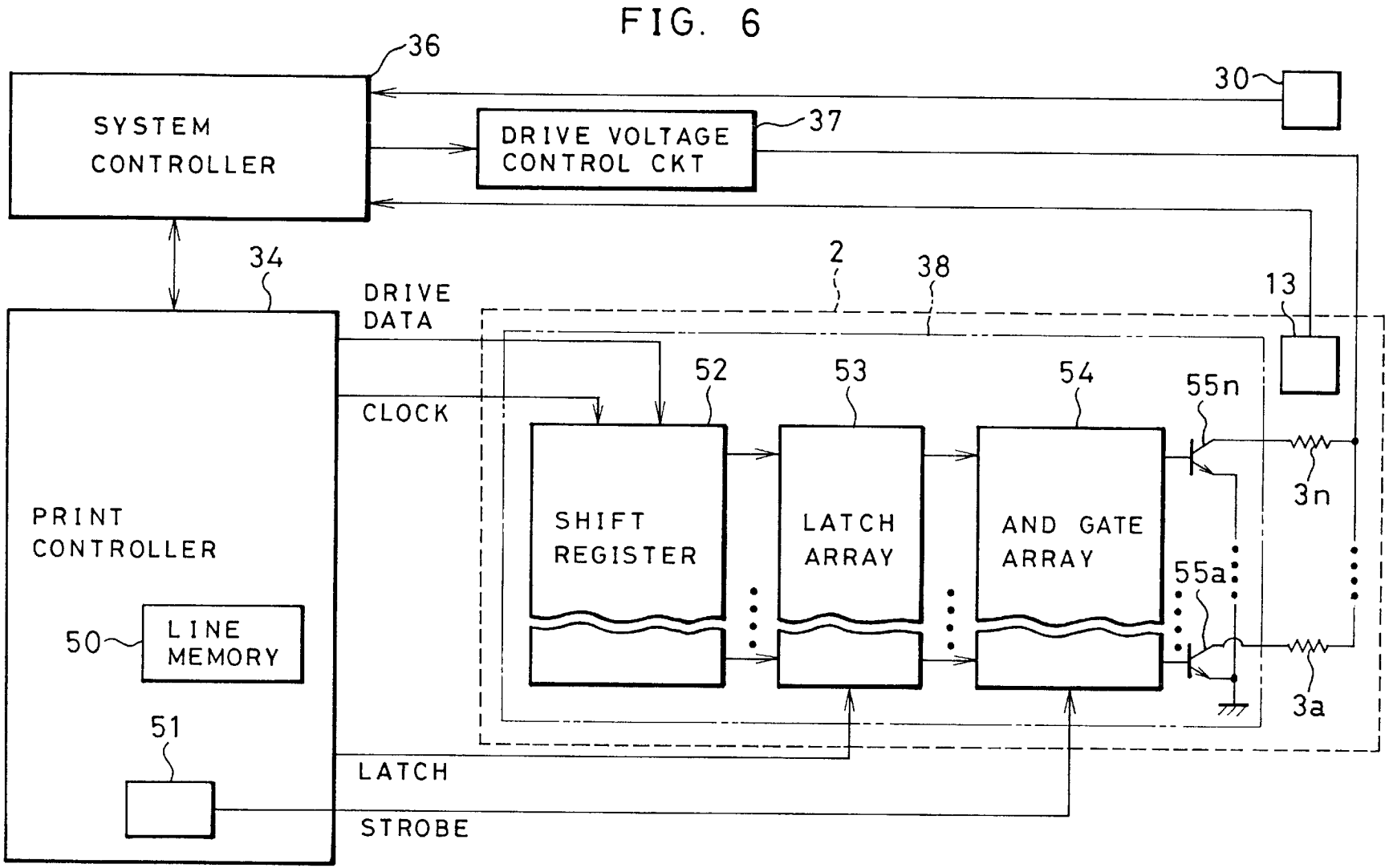
FIG. 6 is a detailed block diagram illustrating the electric construction of the thermal head.

FIG. 4 shows the circuitry of a direct thermal printer according to the first embodiment of the present invention. In a print section 28, image data from a not shown image input device such as a video camera, video player, TV game machine or the like, is inputted through an image input circuit 33. The image data is converted into a digital form and is subjected to density correction and other processing in an image processor 31. The processed image data of one frame is stored in a frame memory 32, from which the image data is read line by line into a print controller 34. According to the image data of one line, the print controller 34 controls a head driver 38 of the thermal head 2 to drive the heating elements 3 so as to record a corresponding line of the image on the recording paper 23.

The respective operations of the print section 28 and the recording medium transport system 26 are sequentially controlled by a system controller 36. The print section 28 further includes a drive voltage control circuit 37 which supplies a drive voltage to the head driver 38 of the thermal head 2 while changing the drive voltage according to voltage data from the system controller 36. Thus, recording density can be changed even for the same image data.

Figure 5:
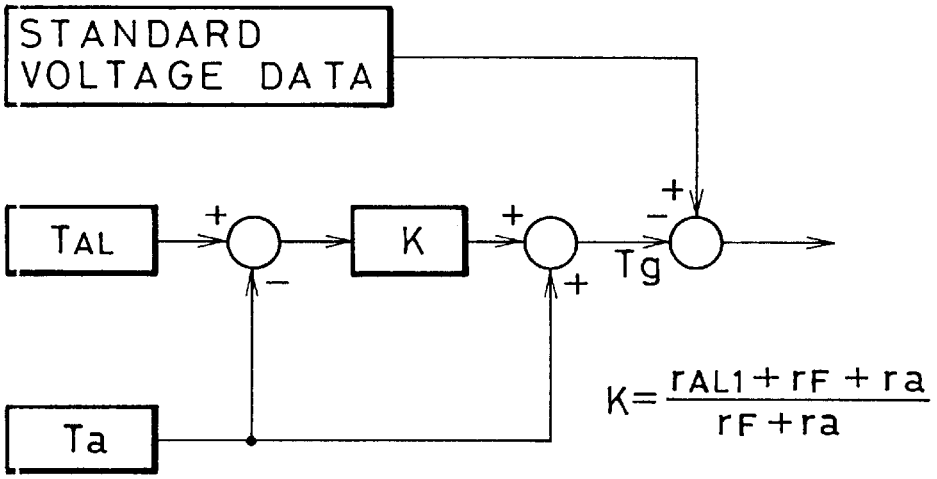
FIG. 5 is an explanatory view illustrating an automatic head drive voltage correction system according to the first embodiment of the invention.

The system controller 36 includes an A/D converter 41, a central processing unit (CPU) 42 and a D/A converter 43. A first temperature signal $T_{AL}$ from the head temperature sensor 13 and a second temperature signal Ta from the ambient temperature sensor 30 are converted into a digital form through the A/D converter 41, and then subjected to an automatic head voltage control operation in the CPU 42, as illustrated in FIG. 5. That is, the CPU 42 calculates or derives from the temperature signals $T_{AL}$ and Ta a present temperature Tg of the grazed glass layer 8 of the heating element 3 according to the above-described equation (3). In order to derive a temperature of the grazed glass layer 8 while the thermal head 2 is cool or not heated, it is preferable to detect the temperature signals $T_{AL}$ and Ta in each cooling period of the thermal head 2 between recording of one line and another.

Then, the CPU 42 calculates a voltage correction value for correcting predetermined standard voltage data so that a long interval variation of the temperature Tg may be obviated. For example, the standard voltage data is reduced by a value corresponding to the calculated temperature Tg. In FIG. 5, the voltage correction value is equivalently represented by the temperature Tg. Thus corrected or modified voltage data is sent to the drive voltage control circuit 37 after being converted into an analog form through the D/A converter 43.

In the drive voltage control circuit 37, a voltage regulator 45 changes a power source voltage of a power source circuit 46 in accordance with the modified voltage data, to output it as a drive voltage. For example, an analog voltage value from the D/A converter 43 is amplified to be the drive voltage by using the power source voltage. In this way, the long interval temperature variation of the heating elements 3 and the thermal head 2 is reduced to a minimum, and so the shading as well as the density variation between the first and the last hard copies of one succession.

Instead of calculating the temperature Tg and the corresponding voltage correction value each time the temperature signals $T_{AL}$ and Ta are detected, it is possible to previously calculate voltage correction values in association with possible variations of the temperature signals $T_{AL}$ and Ta, and store the correction values in form of look-up table data.

Now the operation of the above embodiment will be described.

While the recording paper 23 is fed to the platen drum 20, the platen drum 20 stops in a home position wherein the clamp member 24 is placed at an upper most position of the periphery of the drum 20, and is set in its release position. When the leading end of the recording paper 23 is moved into the upper most position, the cam mechanism 25 actuates the clamp member 24 to clamp the leading end of the recording paper 23. Then, the platen drum 20 starts rotating to wind the recording paper 23 on the periphery.

The system controller 36 actuates the print section 28 to start thermal recording when a print start margin of the recording paper 23 reaches under the array of the heating elements 3 of the thermal head 2.

In thermal recording, first bias drive data is generated from the print controller 34, and is applied to a thermal head driver 38 of the thermal head 2. The thermal head driver 38 supplies each heating element 3 with at least a bias drive pulse which corresponds in number or in width with the bias drive data, to apply a predetermined bias heating energy to the recording paper 23.

Next, the image data is read out line by line from the frame memory 32, and is written in a line memory 50 of the print controller 34. The image data of one line is read out from the line memory 50, and compared with a series of comparison data representing predetermined tonal steps, to output image drive data. The image drive data has a high level "H" when the image data of that pixel is larger than the comparison data. The image drive data is serially sent from the print controller 34 to the thermal head driver 38 of the thermal head 2. The image drive data generating method and apparatus may be equivalent to those disclosed in U.S. application Ser. No. 08/262,333now U.S. Pat. No. 5,608,333.

In the thermal head driver 38, the serial drive data is shifted in a shift register 52 at the timing of a clock signal, so as to be converted into a parallel form. The parallel drive data is latched in a latch array 53 in synchronism with a latch signal generated from the print controller 34. The latch array 53 includes a number of elements corresponding to the number "n" of the pixels consisting of one line (n= an integer). The parallel outputs of the latch array 53 are connected to an AND gate array 54 including the corresponding number "n" of AND gates. The AND gate array 54 receives a strobe signal from a strobe signal generator 51 which is included in the printer controller 34. If the one bit of the drive data that is just applied to a first input of one AND gate is high when the strobe signal is applied to a second input of that AND gate, the AND gate outputs a high level signal "H".

The parallel outputs of the AND gate array 54 are connected to transistors 55*a* to 55*n* in one to one relation, each of which is turned ON when the associated output of the AND gate array 54 takes the high level "H". The transistors 55*a* to 55*n* are connected in series to the heating elements 3*a* to 3*n* of the thermal head 20 in one to one relation. The heating elements 3*a* to 3*n* are each individually supplied with the drive voltage from the drive voltage control circuit 37 so long as the associated one of the transistors 55*a* to 55*n* is set conductive. Thus, variable numbers of image drive pulses corresponding in number to the image data and in amplitude to the drive voltage are applied to the heating elements 3*a* to 3*n*, to record pixels of one line at variable densities. After one line of the image is thus recorded, the platen drum 20 is rotated by a regular amount to transport the recording paper 23 by one line. Then, next line of the image is recorded in the same way as for the first line. In this way, the image is recorded one line after another.

While the thermal recording is carried out, the CPU 42 derives the temperature Tg of the grazed glass layer 8 from the temperature signals $T_{AL}$ and Ta measured by the head temperature sensor 13 and the ambient temperature sensor 30, and corrects the standard voltage data with a voltage correction value corresponding to the temperature Tg. According to the corrected voltage data, the drive voltage control circuit 37 changes the drive voltage to be supplied to the heating elements 3*a* to 3*n*, so that the cool head temperature is kept substantially constant throughout the printing, and the heat accumulation in the thermal head has hardly any influence on the recording density.

Figure 7:
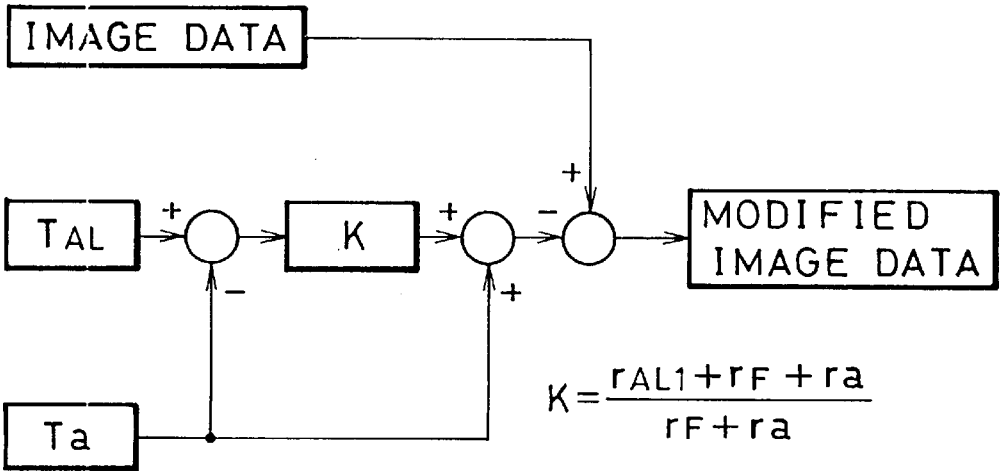
FIG. 7 is an explanatory view illustrating an automatic image data correction system according to a second embodiment of the invention, wherein image data is corrected to obviate the long interval variation of the head temperature.

Although the above embodiment changes the drive voltage to the thermal head 2 in accordance with the calculated temperature Tg of the grazed glass layer 8, it is alternatively possible to change the number of image drive pulses in accordance with the temperature Tg so as to minimize the long interval variation of the actual temperature of the grazed glass layer 8 in the non-heated condition of the thermal head 2. For instance, the system controller 36 calculates a correction value for the image data based on the temperature Tg derived according to the equation (3), that is, from the temperatures $T_{AL}$ and Ta measured by the head temperature sensor 13 and the ambient temperature sensor 30. As is schematically shown in FIG. 7, the image data is modified with the correction data, that is equivalently represented by the temper ature Tg, for instance, in the print controller 34. Thus, the number of image drive pulses is changed corresponding to the modified image data.

It is also possible to change the pulse width of the image drive pulses. In this embodiment, the width of the strobe pulse from the strobe signal generator 51 is changed with the correction value determined based on the temperature Tg in the system controller 34.

Figure 8:
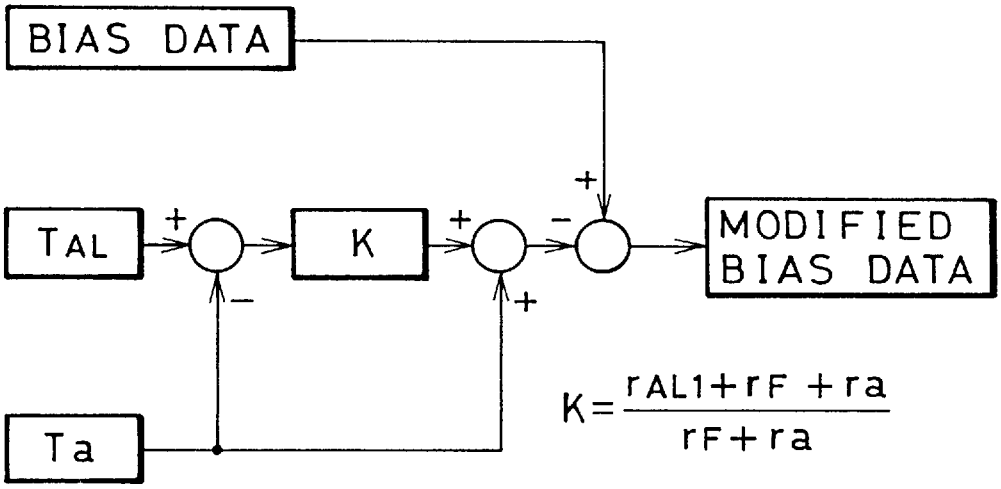
FIG. 8 is an explanatory view illustrating an automatic bias data correction system according to a third embodiment of the invention, wherein bias data is corrected to obviate the long interval variation of the head temperature.

As shown in FIG. 8, the number or the width of the bias drive pulses may be changed according to the temperature Tg so as to eliminate the long interval temperature variations of the grazed glass layers 8 in general. For instance, the number of bias drive pulses or the width of a bias drive pulse to be supplied to each heating element is changed according to the temperature Tg. Or otherwise, the width of a number of bias drive pulses may be changed by changing the width of the strobe signal according the temperature Tg.

Although the embodiments of the present invention have been described with respect to a monochromatic direct thermal printer, the present invention is not limited to the above embodiments. On the contrary, the present invention is applicable to color direct thermal printers, color and monochromatic thermal dye transfer printers, as well as color and monochromatic thermal wax transfer printers. The present invention is not to be limited to a line printer, but applicable to a serial printer. The present invention is preferable especially for the color direct thermal printer, which records three primary color frames in a frame sequential fashion to print a full-color image on a recording sheet, while using different heat ranges for colors. Since the present invention achieves accurate reproduction of the tonal level of each pixel, not only the shading but also color variance are prevented.

Thus, the present invention should not be limited to the above-described embodiment, but variations and modifications of the invention may be possible without departing from the scope of the appended claims.

What is claimed is:

1. A thermal printer comprising:

a thermal head having a heating element, said heating element including a resistance element formed on a grazed glass layer, said grazed glass layer being formed on a substrate;

a first temperature sensor disposed in said substrate to measure a first temperature;

a second temperature sensor disposed in an atmosphere surrounding said thermal head to measure a second temperature;

a device, coupled to and receiving measurements from said first and second temperature sensor, for deriving a third temperature from the first and second temperatures, taking account of heat resistance of said substrate, said third temperature indicating a temperature of said grazed glass layer of said heating element; and a control device for controlling electric energy supplied to said resistance element of said heating element in accordance with the third temperature.

2. A thermal printer according to claim 1, wherein said control device controls electric energy to said resistance element by changing head drive voltage supplied to said resistance element.

3. A thermal printer according to claim 1, wherein said electric energy is supplied to said resistance element as a number of bias drive pulses and a number of image drive pulses, and said control device changes the number or a width of said image drive pulses in accordance with the third temperature.

4. A thermal printer according to claim 1, wherein said electric energy is supplied to said resistance element as a number of bias drive pulses and a number of image drive pulses, and said control device changes the number or a width of said bias drive pulses in accordance with the third temperature.

5. A thermal printer comprising:

a thermal head having a heating element, said heating element including a resistance element formed on a grazed glass layer, said grazed glass layer being formed on one side of a substrate;

a heat radiation plate mounted to an opposite side of said substrate from said grazed glass layer;

a first temperature sensor disposed in said substrate to measure a first temperature;

a second temperature sensor disposed in an atmosphere surrounding said thermal head to measure a second temperature;

a device, coupled to and receiving measurements from said first and second temperature sensors, for deriving a third temperature from the first and second temperatures, according to an equation;

$$Tg=\{(rAL+rF+ra)(T_{AL}-Ta)/(rF+ra)\}+Ta,$$

wherein

Tg represents the third temperature, rAL represents the heat resistance from said substrate to said first temperature sensor, rF represents the heat resistance of said radiation plate, ra represents the heat resistance of the atmosphere, $T_{AL}$ represents the first temperature detected by said first temperature sensor, and Ta represents the second temperature detected by said second temperature sensor, and a control device for controlling electric energy supplied to said resistance element in accordance with the third temperature.

6. A thermal printer according to claim 5, wherein said control device controls electric energy to said resistance element by changing head drive voltage supplied to said resistance element.

7. A thermal printer according to claim 5, wherein the electric energy is supplied to said resistance element as a number of bias drive pulses and a number of image drive pulses, and said control device changes the number or a width of image drive pulses in accordance with the third temperature.

8. A thermal printer according to claim 5, wherein electric energy is supplied to said resistance element as a number of bias drive pulses and a number of image drive pulses, and said control device changes the number or a width of bias drive pulses in accordance with the third temperature.

9. A method of driving a thermal head of a thermal printer having a heating element on the thermal head, the heating element being constituted of a resistance element formed on a grazed glass layer which is formed on a substrate, a first temperature sensor disposed in the substrate, and a second temperature sensor disposed in an atmosphere surrounding the thermal head, said method comprising the steps of:

measuring a first temperature by the first temperature sensor;

measuring a second temperature by the second temperature sensor;

deriving a third temperature from the first and second temperature, taking account of heat resistance of the substrate; and controlling electric energy supplied to the resistance element in accordance with the third temperature.

10. A method according to claim 9, wherein said controlling step includes the step of changing head drive voltage supplied to the resistance element.

11. A method according to claim 9, further comprising the steps of supplying electric energy to the resistance element as a number of bias drive pulses and a number of image drive pulses, wherein said controlling step includes the step of changing the number or a width of the image drive pulses in accordance with the third temperature.

12. A method according to claim 9, further comprising the steps of supplying electric energy to the resistance element as a number of bias drive pulses and a number of image drive pulses, wherein said controlling step includes the step of changing the number or a width of the bias drive pulses in accordance with the third temperature.

13. A method of driving a thermal head of a thermal printer having a heating element on the thermal head, the heating element including a resistance element formed on a grazed glass layer which is formed on one side of a substrate, a heat radiation plate mounted to an opposite side of the substrate from the grazed glass layer, a first temperature sensor disposed in the substrate, and a second temperature sensor disposed in an atmosphere surrounding the thermal head, said method comprising the steps of:

measuring a first temperature by the first temperature sensor;

measuring a second temperature by the second temperature sensor;

deriving a third temperature from the first and second temperatures, according to an equation;

$$Tg=\{(rAL+rF+ra)(T_{AL}-Ta)/(rF+ra)\}+Ta,$$

wherein

Tg represents the third temperature, rAL represents heat resistance from the substrate to the first temperature sensor, rF represents heat resistance of the radiation plate, ra represents heat resistance of the atmospheres, $T_{AL}$ represents the first temperature detected by the first temperature sensors, Ta represents the second temperature detected by the second temperature sensor, and controlling electric energy supplied to the resistance element in accordance with the third temperature.

14. A thermal printer comprising:

a thermal head having a heating element, said heating element including a resistance element formed on a grazed glass layer, said grazed glass layer being formed on a substrate;

a temperature sensor disposed in said substrate to measure a first temperature;

a device for deriving a second temperature from the first temperature measured by said temperature sensor, the second temperature being derived to correspond to an outer surface temperature of said grazed glass layer by taking into account the heat resistance of material between a surface of said grazed glass layer and said temperature sensor; and a control device for controlling electric energy supplied to said resistance element in accordance with the second temperature.

15. A thermal printer according to claim 14, wherein said device for deriving a second temperature takes into account heat resistance of said substrate and heat resistance of said grazed glass layer.

16. A thermal printer according to claim 14, further comprising:

a heat radiation plate mounted on an opposite side of said substrate from said grazed glass layer, wherein said device for deriving a second temperature takes into account heat resistance of said heat radiation plate.

17. A method for driving a thermal head of a thermal printer having a heating element on the thermal head, the heating element including a resistance element formed on a grazed glass layer, the grazed glass layer being formed on a substrate, and a temperature sensor disposed in the substrate, said method comprising the steps of;

measuring a first temperature with the temperature sensor;

deriving a second temperature from the first temperature measured by the temperature sensor, the second temperature being derived to correspond to an outer surface temperature of the grazed glass layer by taking into account the heat resistance of material between a surface of the grazed glass layer and the temperature sensor; and controlling electric energy supplied to the resistance element in accordance with the second temperature.

18. A method according to claim 17, wherein said step of deriving a second temperature takes into account heat resistance of the substrate and heat resistance of the grazed glass layer.

19. A method according to claim 17, wherein a heat radiation plate is positioned on an opposite side of the substrate from the grazed glass layer, and said deriving step takes into account heat resistance of the heat radiation plate when deriving the second temperature.

* * * * *